US006202851B1

(12) United States Patent
Walker

(10) Patent No.: US 6,202,851 B1
(45) Date of Patent: Mar. 20, 2001

(54) BOW BOX

(76) Inventor: Erica Denise Walker, 3985 Honeysuckle La., Conley, GA (US) 30288

( * ) Notice: Subject to any disclaimer, the term of this patent is extended or adjusted under 35 U.S.C. 154(b) by 0 days.

(21) Appl. No.: 09/418,243

(22) Filed: Oct. 14, 1999

Related U.S. Application Data

(60) Provisional application No. 60/104,868, filed on Oct. 19, 1998.

(51) Int. Cl.[7] ..... B65D 69/00
(52) U.S. Cl. ..... 206/579
(58) Field of Search ..... 206/6.1, 457, 566, 206/581, 575, 579; 220/523, 524, 525, 555

(56) References Cited

U.S. PATENT DOCUMENTS 4,120,394 * 10/1978 Soltes ..... 206/6.1
4,262,431 * 4/1981 Darnell ..... 434/170
4,807,760 * 2/1989 Sussman ..... 206/581
4,936,463 * 6/1990 Tiramani ..... 206/581
4,978,001 * 12/1990 Nelson ..... 206/6.1
5,035,319 * 7/1991 Kunisch ..... 206/6.1
5,299,683 * 4/1994 Poole ..... 206/581
5,511,873 * 4/1996 Mech ..... 206/566
5,725,382 * 3/1998 Walter et al. ..... 434/258
5,941,255 * 8/1999 Chen ..... 206/581
6,026,960 * 2/2000 Cogliano ..... 206/457

* cited by examiner

*Primary Examiner*—David T. Fidei

(57) ABSTRACT

The present invention relates to an accessory box that functions as a storage device for hair grooming articles and as a teaching aid. The box is constructed with a lid and bottom where the lid is provided prongs protruding form the inside. The prongs are adapted to prevent the entanglement of barrettes when the box is being carried or closed. Also provided on the lid is indicia in the form of colors, numbers and alphabets. In the bottom of the box compartments are provided to hold other accessories. Clear covers between the lid and bottom function as a work station when they are folded out and hold the contents in the bottom of the box when closed.

4 Claims, 3 Drawing Sheets

OUTSIDE OF BOX

"My Bow Box"
12"
18"

INSIDE OF BOX 3
4
5
6
7
8
9
10
ABCDEFGH J LM
NOPQR VWX Z
12"
18"

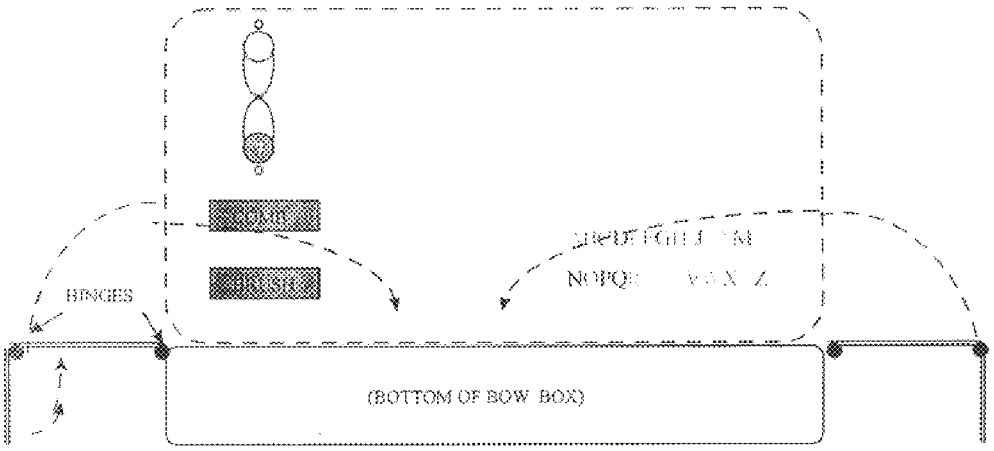
Fig 10.
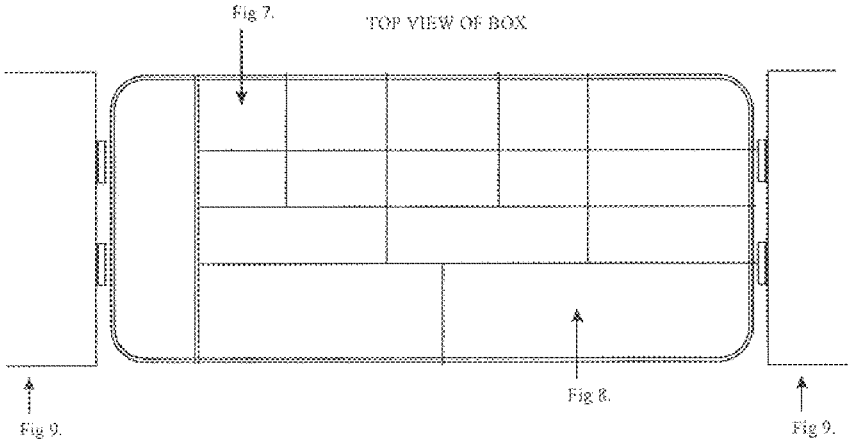

BOW BOX

This application claims the benefit of Provisional application Ser. No. 60/104,868, filed Oct. 19, 1998.

BACKGROUND OF THE INVENTION

The present invention relates to a Hair Accessory Box that serves as a storage case for combs, brush, hair barrettes, and all types of hair decorations, creams, sprays, or hair oils used on the hair.

Object of the Invention

This Hair Accessory Box teaches children alphabets as well as numbers and colors. Repetition has been proven to teach children. The child will see their alphabets, numbers, and colors on a daily basis as the parent dresses the child's hair. The top of the box will serve as a learning board.

The present invention also prevents the barrettes that have the elastic band in the middle and the two balls or plastic figures on the end from becoming entangled. The prongs that are on the inside of the box prevent the entanglement of the barrettes while the box is being carried or closed. At the end of each prong is a circle or square or any different type of shape. Inside the shapes are colors and numbers.

The present invention may come in any size, color, or with any decorations. This Hair Accessory Box can be made from any type of plastic, wood, leather, metal, or any other type of materials.

BRIEF DESCRIPTION OF THE INVENTION

Figures 1, 2, 3:
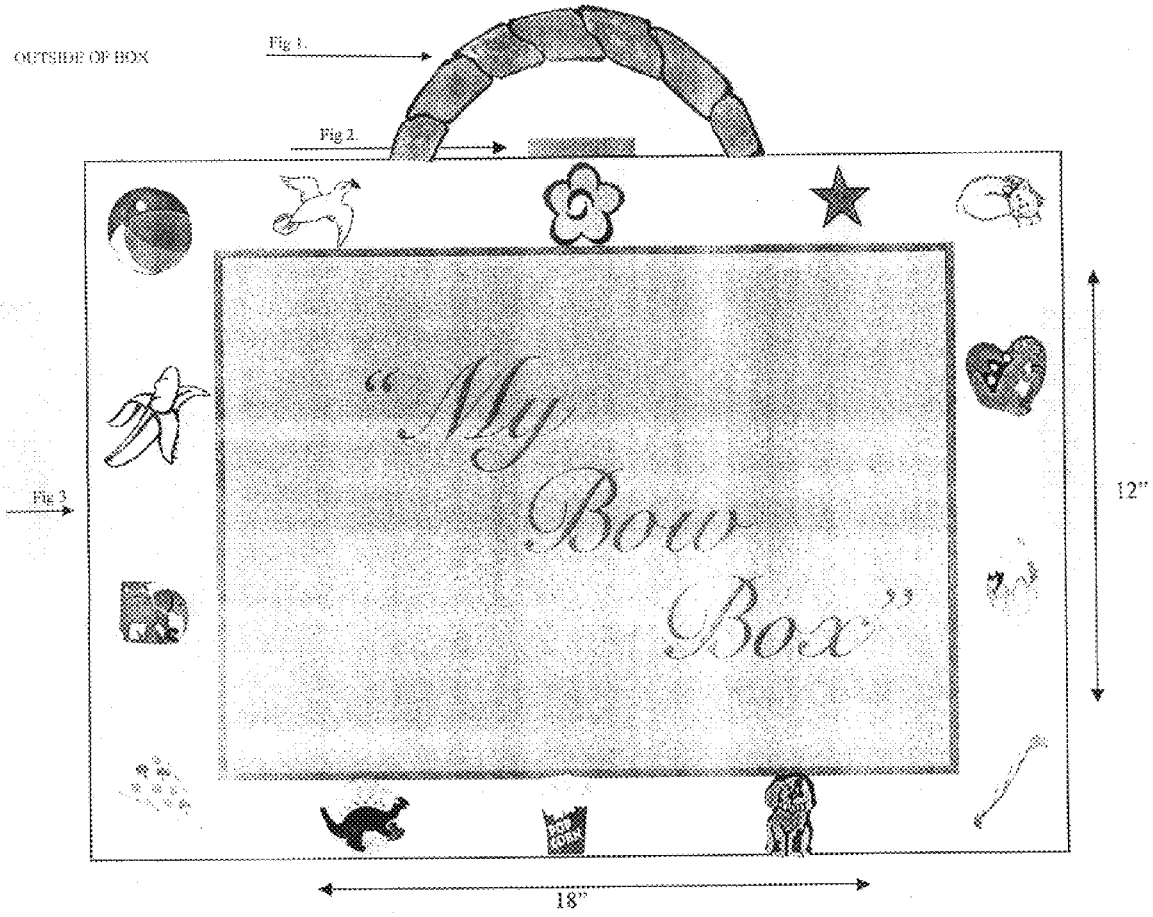

FIG. 1. This handle would be used for carrying the box.

FIG. 2. This is the lock that will be used to lock the top and bottom of the box together.

FIG. 3. This would be how the front and back of the bow box would look. (The colors and prints may vary)

Figures 4, 5, 6:
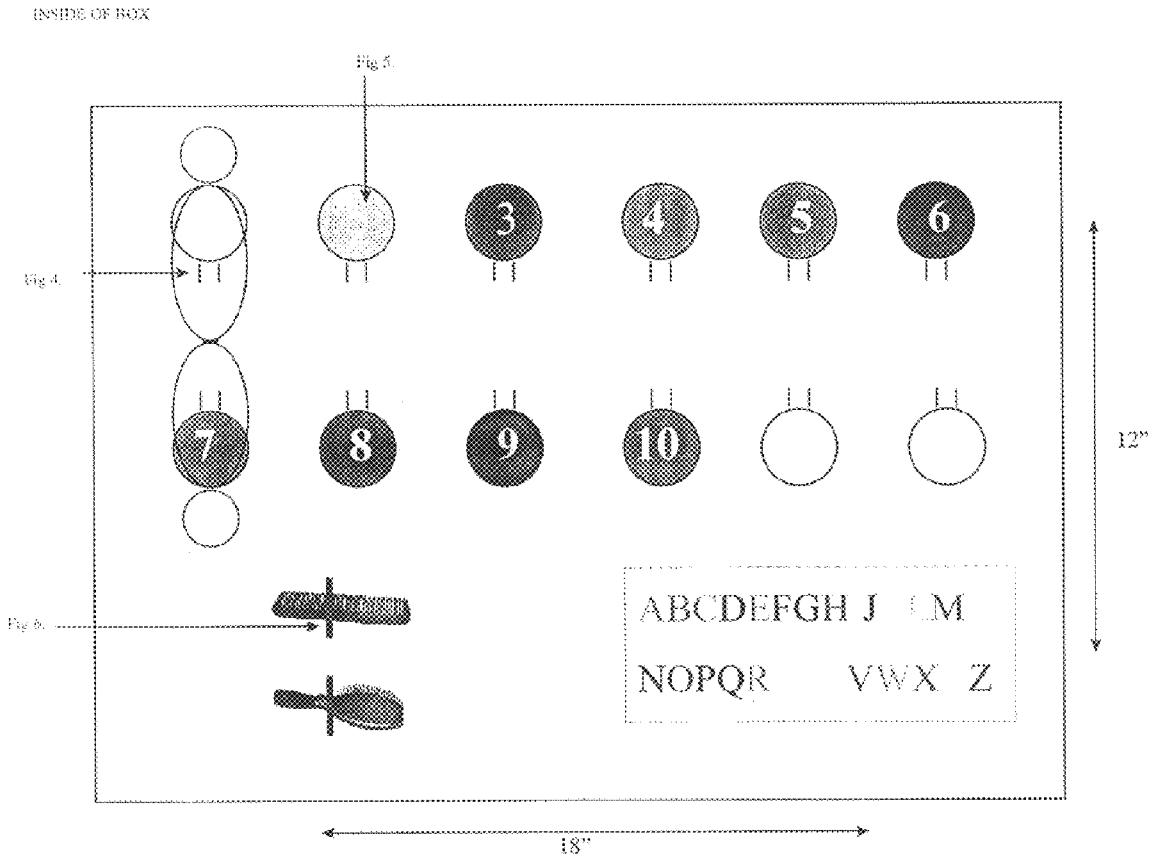

FIG. 4. These small poles protrude from the inside of the box they are used to support and prevent the barrettes from becoming entangled.

FIG. 5. These ends on the poles would be wide enough to prevent the barrettes from sliding off when the box is closed.

FIG. 6. These are elastic bands that would be used to hold the comb and brush.

FIG. 7. These compartments will hold the smaller snaps bow etc.

FIG. 8. These compartments will hold hair grease or cremes used on the hair.

FIG. 9. This will be two transparent covers used to cover contents in the bottom of the box. When the covers are folded out they can be used as a workstation.

FIG. 10. This is the handle that would be used for easy lifting of the covers and would serve as support for the workstation.

DETAILED DESCRIPTION OF THE PREFERRED EMBODIMENT

The bow box will be used to store hair barrettes and hair accessories. This Accessory Box will also be used as a primary teaching device, giving young children the opportunity to learn colors, numbers, and alphabets. It will also enhance organization and coordination skills, while teaching responsibility.

This box can be made of plastics, metal, or wood, with many different colors and prints. Sizes may vary (luggage type carrying case). Located in the lid are prongs protruding from the inside of the box that will prevent the barrettes from becoming entangled as shown in the picture. On the end of the prongs are circles and on the circles are colors and numbers.

Below the prongs are two small 2" elastic bands that hold the comb and brush. To the right of the bands is an alphabet chart.

In the bottom of the box are small compartments that will hold the smaller snap bows, rubber bands, etc. One compartment of the box is as long as the bottom of the box and this compartment will be used only to hold hair oils and creams.

There is a clear divider between the lid and the bottom that will hold the contents snugly in place when the box is closed.

What is claimed is:

1. An accessory box for storage of hair grooming articles and adapted to serve as a teaching aid comprising:

a lid section and bottom section engagable with one another to form an enclosure, said lid section having a plurality of prongs for preventing the entanglement of barrettes, each prong extending from an inside surface of said lid section and spaced apart from one another so that each prong may receive an end of a barrette, indicia provided on the box so that repeated exposure thereto functions as a teaching aid; and, said bottom section including at least one compartment, whereby said lid section and said bottom section may be moved between an open position permitting access to articles contained within the enclosure and closed position wherein the articles are stored within the enclosure.

2. The box of claim 1, wherein said bottom section includes a pair of covers foldable between a first retaining position and a second outwardly extending position that is used as a workstation.

3. The box of claim 2, wherein said covers are transparent.

4. The box of claim 1, wherein said indicia is provided on an inside surface of said lid section and selected from any of the group comprising; numbers, colors or letters.

* * * * *